US010443163B2

(12) United States Patent
Boys et al.

(10) Patent No.: US 10,443,163 B2
(45) **Date of Patent: *Oct. 15, 2019**

(54) SHOE HAVING KNIT WINGTIP UPPER

(71) Applicant: Cole Haan LLC, New York, NY (US)

(72) Inventors: Jack Boys, New York, NY (US); Ann Bono, New York, NY (US); Aubert Shepherd, Greenland, NH (US); Mattias Verfl, New York, NY (US)

(73) Assignee: COLE HAAN LLC, New York, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/409,970

(22) Filed: May 13, 2019

(65) Prior Publication Data

US 2019/0261741 A1 Aug. 29, 2019

Related U.S. Application Data

(63) Continuation of application No. 15/205,672, filed on Jul. 8, 2016, now Pat. No. 10,327,511.

(51) Int. Cl.

| | |
|---|---|
| ***D04B 1/24*** | (2006.01) |
| ***A43B 1/04*** | (2006.01) |
| ***D04B 1/10*** | (2006.01) |
| ***A43B 23/04*** | (2006.01) |
| ***D04B 1/22*** | (2006.01) |

(52) U.S. Cl.

CPC ..... *D04B 1/24* (2013.01); *A43B 1/04* (2013.01); *A43B 23/042* (2013.01); *D04B 1/104* (2013.01); *D04B 1/22* (2013.01); *D10B 2501/043* (2013.01)

(58) Field of Classification Search

CPC .. D04B 1/10; D04B 1/104; D04B 1/24; A43B 23/0245; A43B 23/04; A43B 23/042

See application file for complete search history.

(56) References Cited

U.S. PATENT DOCUMENTS

| | | | |
|---|---|---|---|
| D97,783 | S | 12/1935 | Peterson |
| 2,312,078 | A | 2/1943 | Crannell |
| D293,386 | S | 12/1987 | Kelley |
| D394,739 | S | 6/1998 | Carlson |
| D401,398 | S | 11/1998 | Carlson |
| 6,910,288 | B2 | 6/2005 | Dua |
| 7,347,011 | B2 | 3/2008 | Dua et al. |
| 2012/0255201 | A1 | 10/2012 | Little |
| 2014/0310985 | A1 | 10/2014 | Tran et al. |
| 2015/0342285 | A1 | 12/2015 | Huffman et al. |

FOREIGN PATENT DOCUMENTS

| | | | |
|---|---|---|---|
| KR | 10-1367445 | B1 | 2/2014 |

*Primary Examiner* — Danny Worrell
(74) *Attorney, Agent, or Firm* — Thompson Coburn LLP

(57) ABSTRACT

A shoe includes a knit upper and a sole secured to the upper. The knit upper has a wingtip pattern knit into the knit upper.

28 Claims, 6 Drawing Sheets

SHOE HAVING KNIT WINGTIP UPPER

CROSS-REFERENCE TO RELATED APPLICATIONS

This is a continuation of U.S. patent application Ser. No. 14/205,672, filed Jul. 8, 2016, which is hereby incorporated by reference in its entirety.

STATEMENT REGARDING FEDERALLY SPONSORED RESEARCH OR DEVELOPMENT

Not Applicable.

APPENDIX

Not Applicable.

BACKGROUND OF THE INVENTION

Field of the Invention

This invention pertains to shoes having knit uppers.

SUMMARY

One aspect of the invention is a shoe comprising a knit upper and a sole secured to the upper. The knit upper has a knitted element. The knitted element is formed of a unitary one-piece construction during a knitting process on a knitting machine. The knitted element comprises a knitted upper heel region, a knitted upper lateral midfoot region, a knitted upper medial midfoot region, a knitted upper metatarsal region, a knitted upper lateral ball region, a knitted upper medial ball region, and a knitted upper toe region. The upper metatarsal region includes a knitted upper lateral metatarsal region and a knitted upper medial metatarsal region. The upper has a knitted upper lateral side region and a knitted upper medial side region. The upper lateral side region includes the upper lateral midfoot region, the upper lateral metatarsal region and the upper lateral ball region. The upper medial side region includes the upper medial midfoot region, the upper medial metatarsal region and the upper medial ball region. The upper toe region is seamlessly knitted with the upper medial and lateral ball regions during the knitting process. The upper medial and lateral ball regions are seamlessly knitted with the upper metatarsal region during the knitting process. The upper metatarsal region is seamlessly knitted with the upper lateral and medial midfoot regions during the knitting process. The knitted element includes a wingtip pattern. The wingtip pattern comprises portions of at least the upper toe region, the upper lateral and medial ball regions, and the upper lateral and medial metatarsal regions. The upper toe region, the upper lateral and medial ball regions, and the upper lateral and medial metatarsal regions collectively are knitted with the wingtip pattern during the knitting process.

Another aspect of the invention is a shoe comprising a knit upper and a sole secured to the upper. The knit upper has a knitted element formed of a unitary one-piece construction during a knitting process on a knitting machine. The knitted element comprises a knitted upper heel region, a knitted upper lateral midfoot region, a knitted upper medial midfoot region, a knitted upper metatarsal region, a knitted upper lateral ball region, a knitted upper medial ball region, and a knitted upper toe region. The upper metatarsal region includes a knitted upper lateral metatarsal region and a knitted upper medial metatarsal region. The upper has a knitted upper lateral side region and a knitted upper medial side region. The upper lateral side region includes the upper lateral midfoot region, the upper lateral metatarsal region and the upper lateral ball region. The upper medial side region includes the upper medial midfoot region, the upper medial metatarsal region and the upper medial ball region. The upper toe region is seamlessly knitted with the upper medial and lateral ball regions during the knitting process. The upper medial and lateral ball regions are seamlessly knitted with the upper metatarsal region during the knitting process. The upper metatarsal region is seamlessly knitted with the upper lateral and medial midfoot regions during the knitting process. The knitted element includes a line of broguing. The upper toe region is knitted with the line of broguing during the knitting process. The line of broguing comprises a line of holes. The knitted element comprises a first area of a first type of knit structure and a second area of a second type of knit structure. The second type of knit structure is different from the first type of knit structure. The first area is at least in the upper toe region. The second area is at least in the upper lateral and medial metatarsal regions. The line of broguing being adjacent a rear boundary of the first area. The line of broguing being adjacent a forward boundary of the second area.

Another aspect of the invention is a method of manufacturing an upper for an article of footwear. The method comprises knitting with a knitting machine to form a knitted element of the upper such that the knitted element is of a unitary one-piece construction comprising a knitted upper heel region, a knitted upper lateral midfoot region, a knitted upper medial midfoot region, a knitted upper metatarsal region, a knitted upper lateral ball region, a knitted upper medial ball region, and a knitted upper toe region. The upper metatarsal region includes an upper lateral metatarsal region and an upper medial metatarsal region. The knitted element has an upper lateral side region and an upper medial side region. The upper lateral side region includes the upper lateral midfoot region, the upper lateral metatarsal region and the upper lateral ball region. The upper medial side region includes the upper medial midfoot region, the upper medial metatarsal region and the upper medial ball region. The knitted element includes a line of broguing. The line of broguing comprises a line of holes. The knitted element comprises a first area of a first type of knit structure and a second area of a second type of knit structure. The second type of knit structure is different from the first type of knit structure. The first area is at least in the upper toe region. The second area is at least in the upper lateral and medial metatarsal regions. The line of broguing being adjacent a rear boundary of the first area. The line of broguing being adjacent a forward boundary of the second area. The upper toe region is seamlessly knitted with the upper medial and lateral ball regions during the knitting step. The upper medial and lateral ball regions are seamlessly knitted with the upper metatarsal region during the knitting step. The upper metatarsal region is seamlessly knitted with the upper lateral and medial midfoot regions during the knitting step. The upper toe region is knitted with the line of broguing during the knitting step. The first and second areas are knitted during the knitting step.

Another aspect of the invention is a method of manufacturing an article of footwear having a knitted upper and a sole. The method comprises knitting with a knitting machine to form a knitted element of the upper such that the knitted element is of a unitary one-piece construction comprising a knitted upper heel region, a knitted upper lateral midfoot region, a knitted upper medial midfoot region, a knitted upper metatarsal region, a knitted upper lateral ball region, a knitted upper medial ball region, and a knitted upper toe region. The upper metatarsal region includes an upper lateral metatarsal region and an upper medial metatarsal region. The knitted element has an upper lateral side region and an upper medial side region. The upper lateral side region includes the upper lateral midfoot region, the upper lateral metatarsal region and the upper lateral ball region. The upper medial side region includes the upper medial midfoot region, the upper medial metatarsal region and the upper medial ball region. The knitted element comprises a first area of a jersey stitch knit and a second area of a pointelle stitch knit. The first area is at least in the upper toe region. The second area is at least in the upper lateral and medial metatarsal regions. The method further comprises attaching the sole to the upper. The upper toe region is seamlessly knitted with the upper medial and lateral ball regions during the knitting step. The upper medial and lateral ball regions are seamlessly knitted with the upper metatarsal region during the knitting step. The upper metatarsal region is seamlessly knitted with the upper lateral and medial midfoot regions during the knitting step. The first and second areas are knitted during the knitting step.

Further features and advantages, as well as the operation, are described in detail below with reference to the accompanying drawings.

Figure 1:
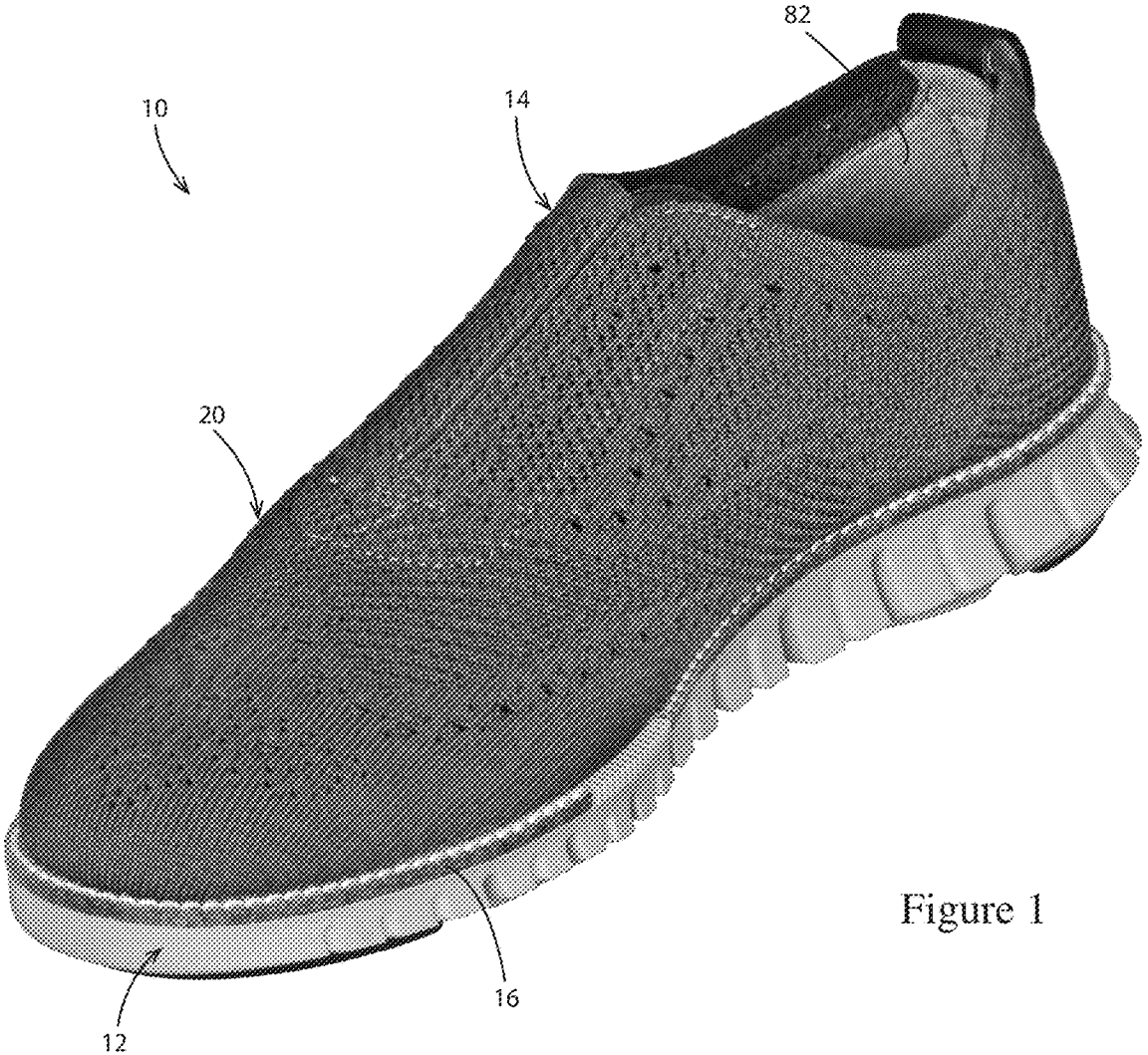
FIG. 1 is a perspective view of an exemplary embodiment of a shoe of the present disclosure.
Figure 2:
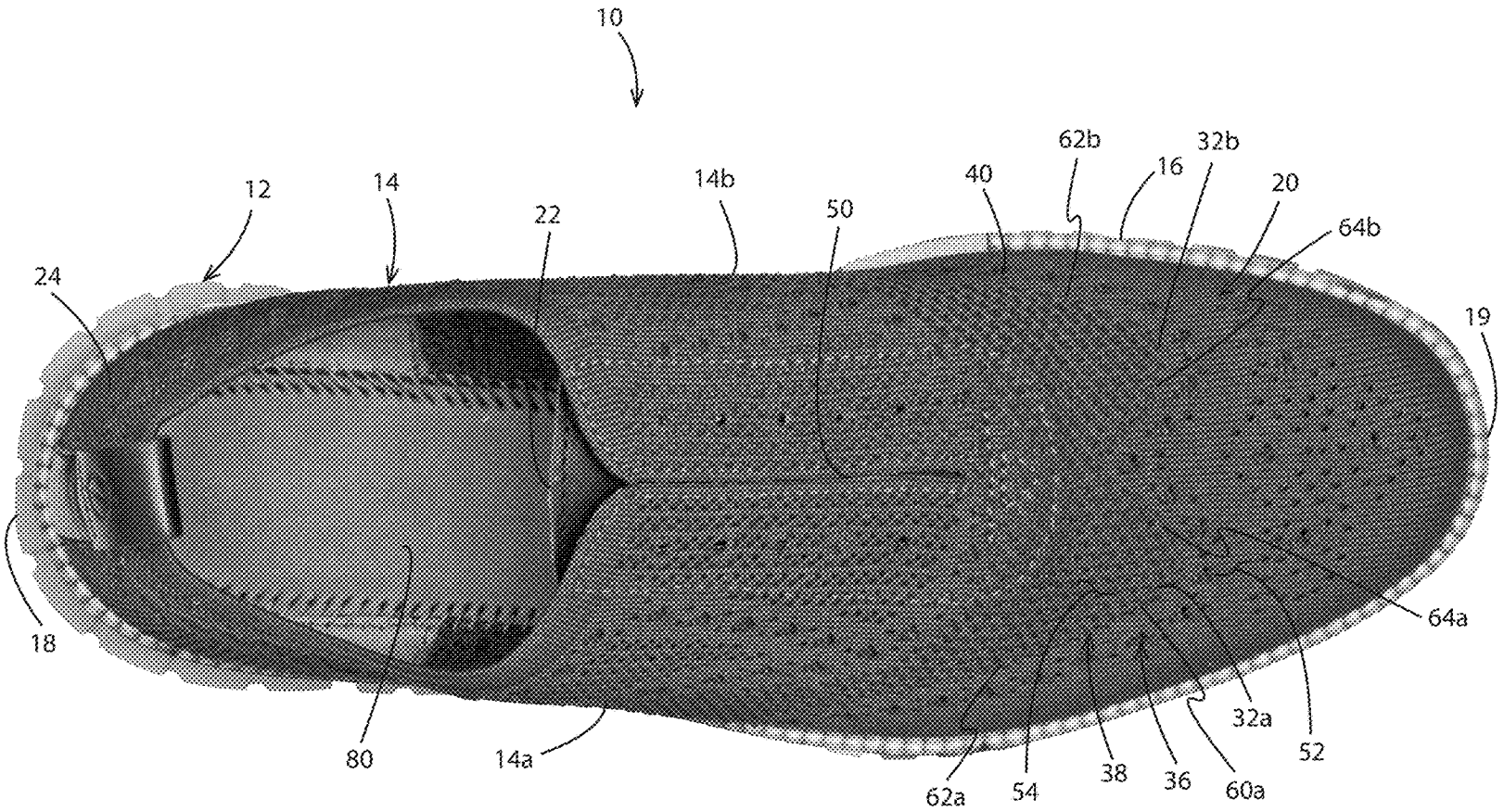
FIG. 2 is a top plan view of the shoe of FIG. 1.
Figure 3:
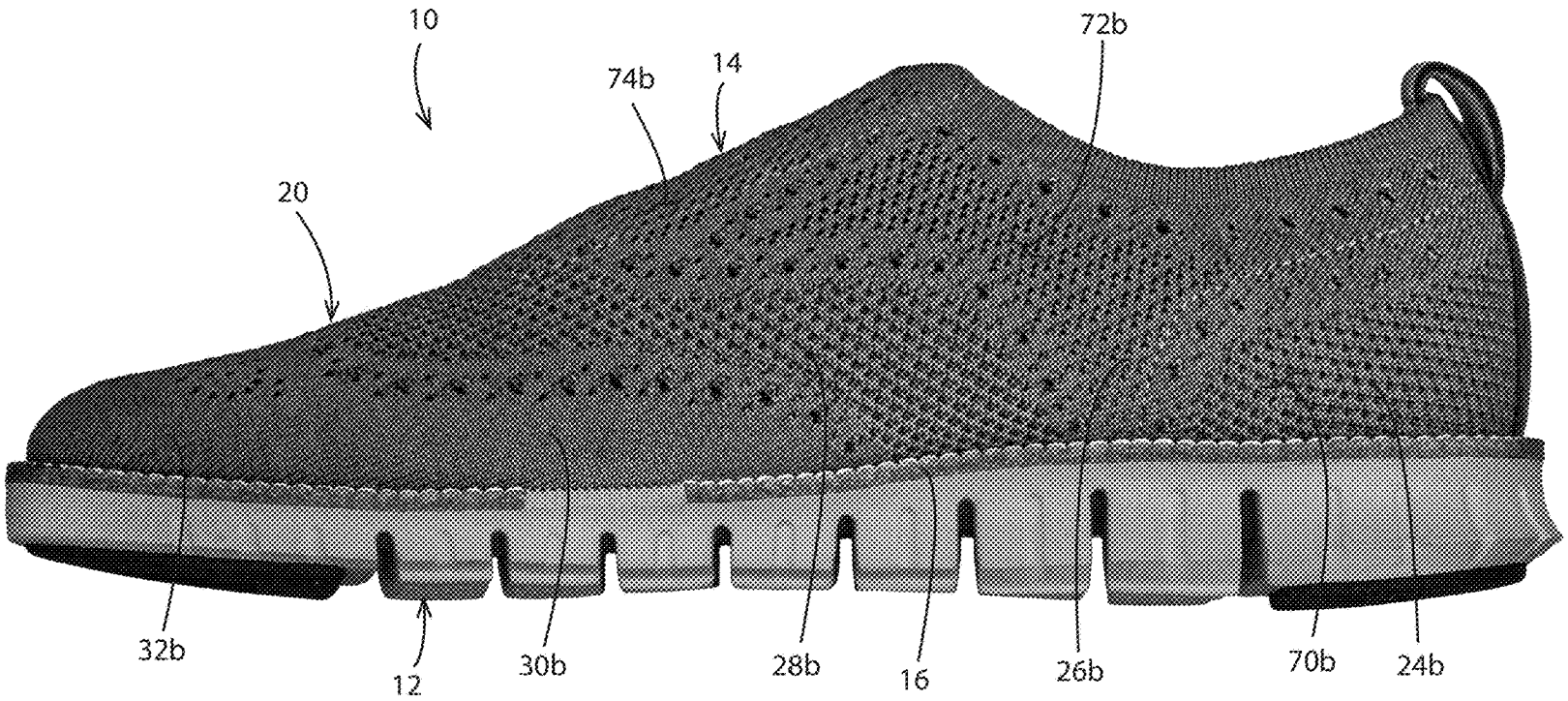
FIG. 3 is a medial side view of the shoe of FIG. 1.
Figure 4:
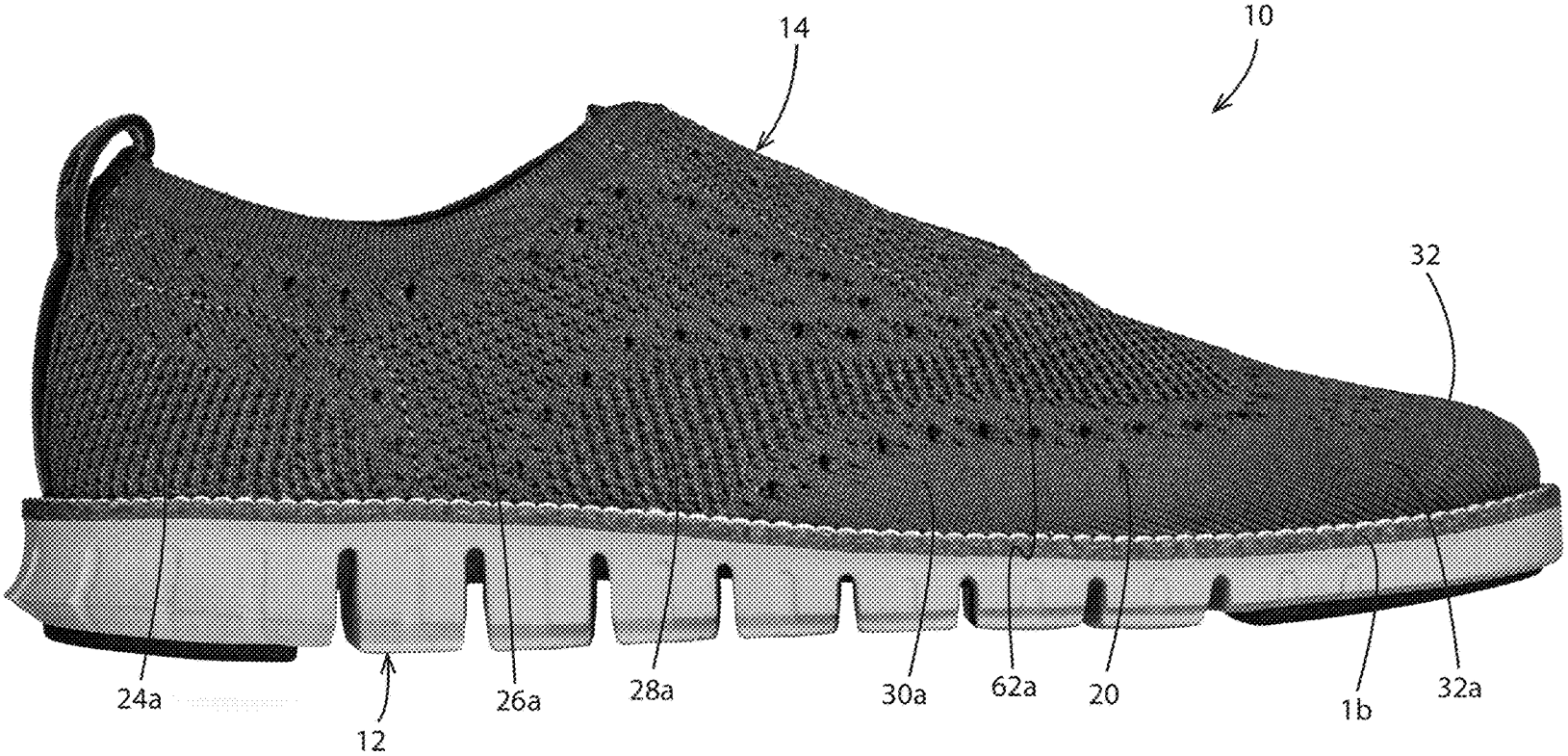
FIG. 4 is a lateral side view of the shoe of FIG. 1.

Reference numerals in the written specification and in the figures indicate corresponding items.

DETAILED DESCRIPTION

An embodiment of a shoe in accordance with the present invention is indicated by reference numeral 10 in FIGS. 1-4. The shoe 10 comprises a sole, generally indicated at 12, a knit upper, generally indicated at 14, and a welt, generally indicated at 16. The sole 12 and welt 16 are secured to the upper 14. The shoe 10 extends forward from a heel end 18 to a toe end 19. The knit upper 14 has a knitted element 20 and a tongue 22 secured to the knitted element. The knitted element 20 is shown alone in FIG. 5 and shown as part of the assembled shoe in FIGS. 1-5.

The knitted element 20 is formed of a unitary one-piece construction during a knitting process on a knitting machine (not shown). The knitted element 20 comprises a knitted upper heel region 24, a knitted upper lateral midfoot region 26*a*, a knitted upper medial midfoot region 26*b*, a knitted upper metatarsal region 28, a knitted upper lateral ball region 30*a*, a knitted upper medial ball region 30*b*, and a knitted upper toe region 32. The upper heel region 24 includes a knitted upper lateral heel region 24*a* and a knitted upper medial heel region 24*b*. The upper metatarsal region 28 includes a knitted upper lateral metatarsal region 28*a* and a knitted upper medial metatarsal region 28*b*. The knitted upper toe region 32 includes a knitted upper lateral toe region 32*a* and a knitted upper medial toe region 32*b*. The upper 14 has a knitted upper lateral side region 14*a* and a knitted upper medial side region 14*b*. The upper lateral side region 14*a* includes the upper lateral heel region 24*a*, the upper lateral midfoot region 26*a*, the upper lateral metatarsal region 28*a*, the upper lateral ball region 30*a*, and the upper lateral toe region 32*a*. The upper medial side region 14*b* includes the upper medial heel region 24*b*, the upper medial midfoot region 26*b*, the upper medial metatarsal region 28*b*, the upper medial ball region 30*b*, and the upper medial toe region 32*b*. The upper toe region 32 is seamlessly knitted with the upper lateral and medial ball regions 30*a*, 30*b* during the knitting process. The upper lateral and medial ball regions 30*a*, 30*b* are seamlessly knitted with the upper lateral and medial metatarsal regions 28*a*, 28*b* during the knitting process. The upper lateral and medial metatarsal regions 28*a*, 28*b* are seamlessly knitted with the upper lateral and medial midfoot regions 26*a*, 26*b* during the knitting process.

The knitted element includes a first wingtip pattern, generally indicated at 36, and a second wingtip pattern, generally indicated at 38. Each of the first and second wingtip patterns 36, 38 comprises portions of at least the upper toe region 32, the upper lateral and medial ball regions 30*a*, 30*b*, and the upper lateral and medial metatarsal regions 28*a*, 28*b*. The upper toe region 32, the upper lateral and medial ball regions 30*a*, 30*b*, and the upper lateral and medial metatarsal regions 28*a*, 28*b* collectively are knitted with the first and second wingtip patterns 36, 38 during the knitting process.

The first wingtip pattern 36 comprises a line of broguing 40 comprising a lateral line of broguing 40*a* and a medial line of broguing 40*b*. The upper toe region 32, the upper lateral and medial ball regions 30*a*, 30*b*, and the upper lateral and medial metatarsal regions 28*a*, 28*b* collectively are knitted with the lateral and medial lines of broguing 40*a*, 40*b*. The lateral line of broguing 40*a* comprises a wing-shaped curved line of holes 42*a*. The lateral line of broguing 40*a* comprises a lateral side broguing portion 44*a* extending forward from at least the upper lateral metatarsal region 28*a* to the upper toe region 32, and a central broguing portion 46*a* extending rearward from the upper toe region 32. The lateral side broguing portion 44*a* and the central broguing portion 46*a* are each comprised of some of the holes 42*a* of the lateral line of broguing 40*a*. The medial line of broguing 40*b* comprises a wing-shaped curved line of holes 42*b*. The medial line of broguing 40*b* comprises a medial side broguing portion 44*b* extending forward from at least the upper medial metatarsal region 28*b* to the upper toe region 32, and a central broguing portion 46*b* extending rearward from the upper toe region 32. The medial side broguing portion 44*b* and the central broguing portion 46*b* are each comprised of some of the holes 42*b* of the medial line of broguing 40*b*. The central broguing portions 46*a*, 46*b* converge rearwardly toward each other, and meet to constitute a rearwardly pointing apex 48. The upper 14 further comprises a throat 50. The apex 48 points rearwardly toward the throat 50 of the upper 14. Preferably, the holes 42*a*, 42*b* of the lateral and medial lines of broguing 40*a*, 40*b* are in the knitting element via the knitting process as opposed to being formed by removal of material such as by cutting or punching.

The knitted element 20 comprises a first area, generally indicated at 52, of a first type of knit structure and a second area, generally indicated at 54, of a second type of knit structure. The second type of knit structure is different from the first type of knit structure. The first area 52 is generally forward of the second area 54. The first area 52 has a rear boundary 56 and the second area 54 has a forward boundary 58. The rear boundary 56 of the first area 52 and the forward boundary 58 of the second area 54 is coincident and coextensive with each other and define a boundary line 60 between the first and second areas 52, 54. The second wingtip pattern 38 comprises the boundary line 60. The first wingtip pattern 36 is forward of and adjacent the second wingtip pattern 38. Also, the lateral and medial lines of broguing 40*a*, 40*b* are adjacent the boundary line 60. As such the lateral and medial lines of broguing 40*a*, 40*b* are adjacent the rear boundary 56 of the first area 52, and adjacent the forward boundary 58 of the second area 54. The boundary line 60 has a lateral boundary line 60*a* and a medial boundary line 60*b*. The lateral boundary line 60*a* comprises a wing-shaped curved line having a lateral side portion 62*a* extending forward from at least the upper lateral metatarsal region 28*a* to the upper toe region 32, and a central portion 64*a* extending rearward from the upper toe region 32. The medial boundary line 60*b* comprises a wing-shaped curved line having a medial side portion 62*b* extending forward from at least the upper medial metatarsal region 28*b* to the upper toe region 32, and a central portion 64*b* extending rearward from the upper toe region 32. The central portions 64*a*, 64*b* of the lateral and medial boundary lines 60*a*, 60*b* converge rearwardly toward each other, and meet to constitute a rearwardly pointing apex 66. The apex 66 points rearwardly toward the throat 50 of the upper 14.

The first type of knit structure (that is, the knit structure of the first area 52) may be more tightly knit than the second type of knit structure (that is, the knit structure of the second area 54). In this embodiment, the first type of knit structure is a jersey stitch knit and the second type of knit structure is a pointelle stitch knit. The knitted element 20 may be knitted with one or more yarns, such as polyester yarns, nylon yarns, cotton yarns, and spandex yarns. In one embodiment, the knitted element 20 is knitted of polyester covered spandex yarn and hot melt yarn, such that in the finished knitted element, the polyester covered spandex yarn constitutes at least 50% by mass (and more preferably at least 60% by mass), and the hot melt yarn constitutes at least 15% by mass (and more preferably at least 20% by mass but not more than 30% by mass). The hot melt yarn is knitted with the polyester covered spandex yarn during the knitting process. Preferably, the polyester covered spandex yarn has a linear density of between about 120 denier and about 180 denier, and the hot melt yarn has a linear density of between about 80 denier and about 120 denier. In addition to the polyester covered spandex yarn and the hot melt yarn, the knitted element 20 may be knitted with stretch yarn, with the stretch yarn preferably constituting at least 5% by mass of the knitted upper. If stretch yarn is included, it is preferably limited (but need not be limited) to the topline area of the knitted element 20 to provide a stretch function primarily in the ankle region of the upper 14 of the shoe 10. Preferably, the polyester covered spandex yarn includes a double layer of polyester. Also preferably, the stretch yarn is spandex yarn. In another embodiment, the knitted element 20 is formed by knitting hot melt yarn with polyester yarn during the knitting process such that polyester yarn constitutes at least 50% by mass of the knitted element and the hot melt yarn constitutes at least 15% by mass of the knitted element.

Figure 5:
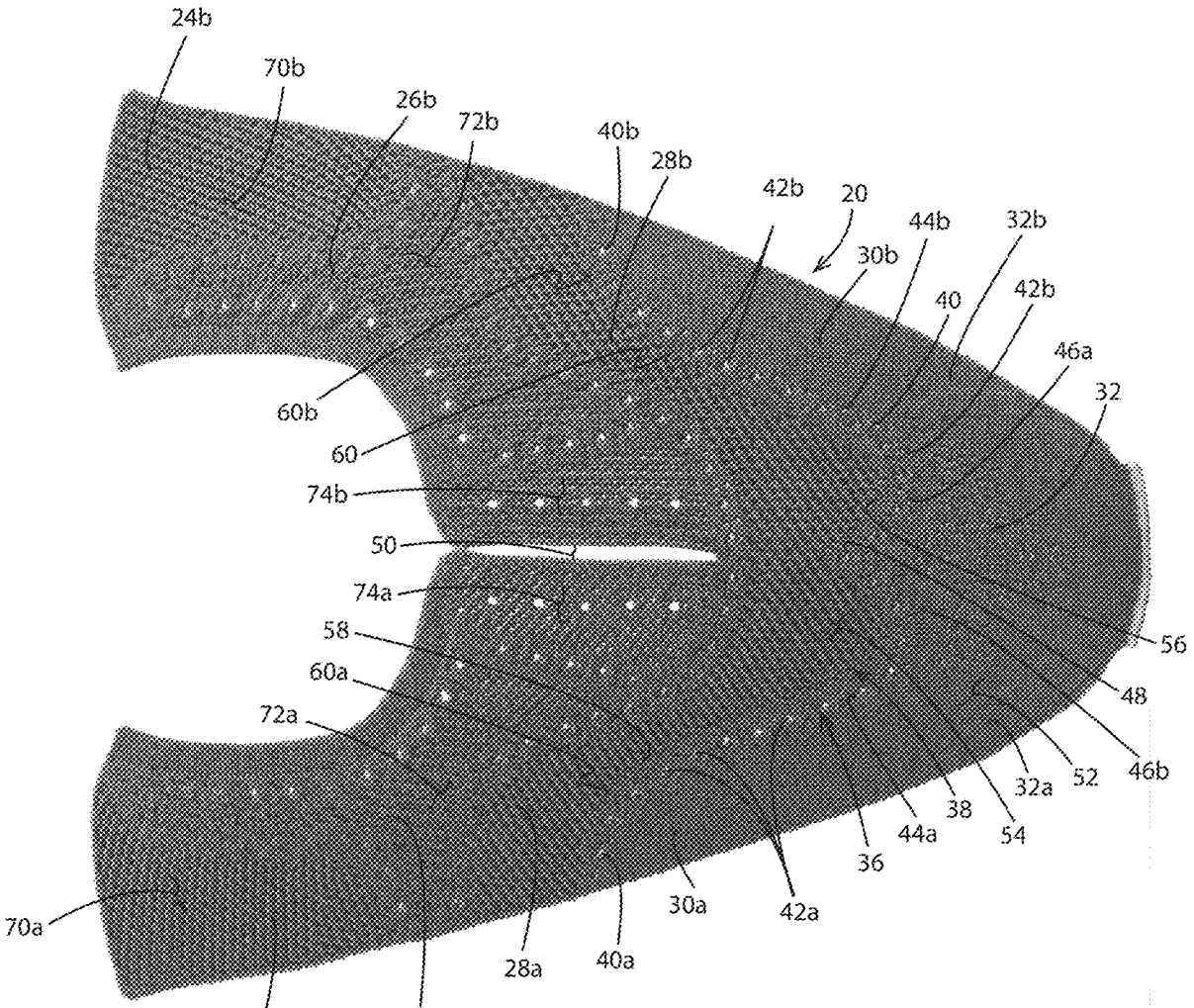
FIG. 5 is a plan view of a knitted element to be formed into a part of an upper of the shoe of FIG. 1.
Figure 6:
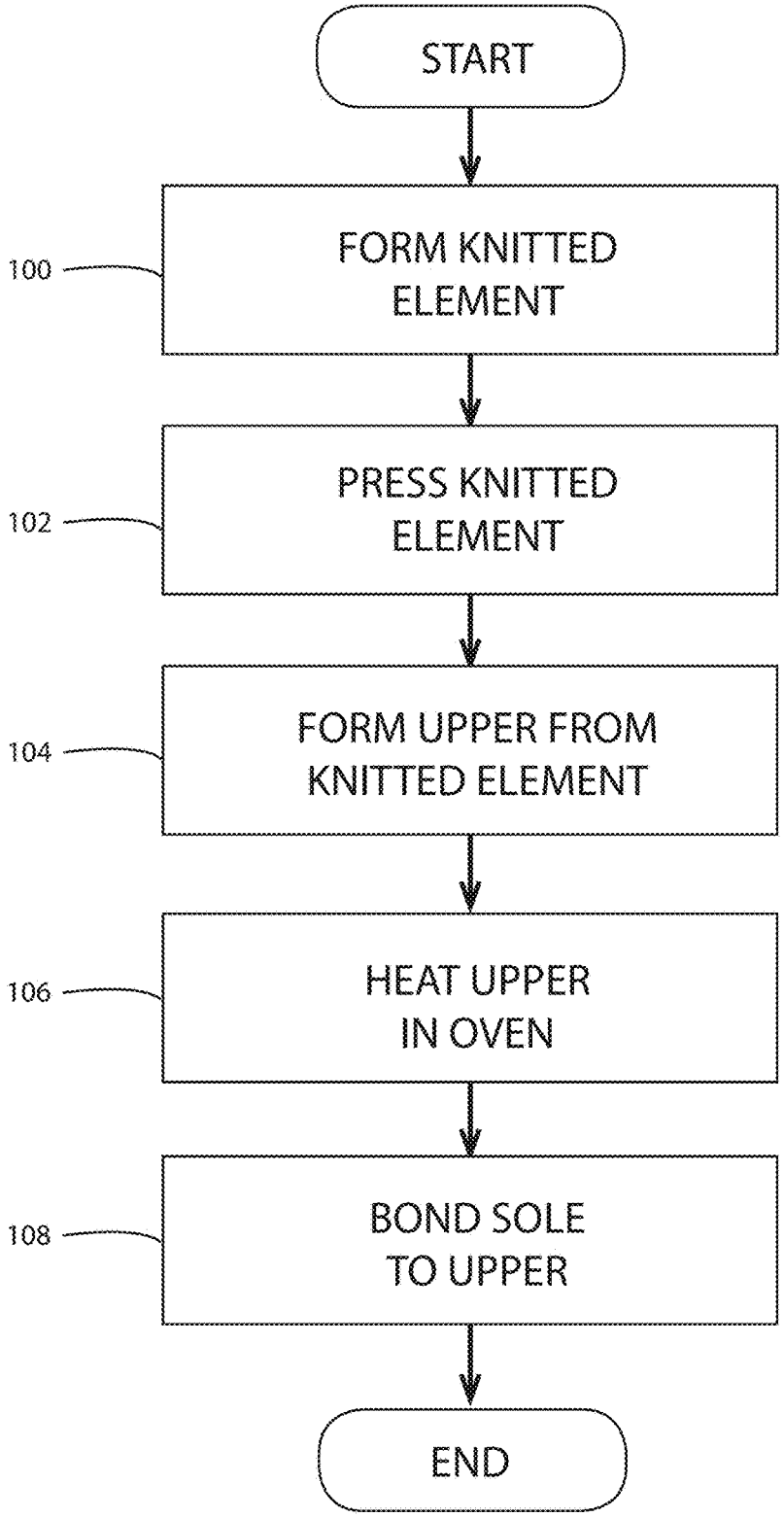
FIG. 6 is a flow diagram of a method of making the shoe of FIG. 1 according to an exemplary embodiment of the present disclosure.

FIG. 6 is a flow diagram of a method of making the shoe 10 of FIGS. 1-5. In step 100, the knitted element 20 is formed via a knitting machine, such as a CNC knitting machine, as a unitary one-piece construction. During the knitting step 100, the upper lateral and medial heel regions 24*a*, 24*b* are knitted, the upper lateral and medial midfoot regions 26*a*, 26*b* are knitted, the upper lateral and medial metatarsal regions 28*a*, 28*b* are knitted, the upper lateral and medial ball regions 30*a*, 30*b* are knitted, and the upper lateral and medial toe regions 32*a*, 32*b* are knitted. By being knitted as a as a unitary one-piece construction, it is to be understood these various regions of the knitted element are formed together via the knitting process, as opposed to the regions being formed separately and then sewn or bonded together. As such, the upper toe region 32 is seamlessly knitted with the upper medial and lateral ball regions 30*a*, 30*b* during the knitting step, the upper medial and lateral ball regions are seamlessly knitted with the upper metatarsal region 28 during the knitting step, the upper metatarsal region is seamlessly knitted with the upper lateral and medial midfoot regions 26*a*, 26*b* during the knitting step, and the upper lateral and medial midfoot regions are seamlessly knitted with the upper lateral and medial heel regions 24*a*, 24*b* during the knitting step.

The knitted element 20 is also knitted with a multiple of different types of knit structures during the knitting step. As described above, the first area 52 is of the first type of knit structure (e.g., jersey stitch knit) and the second area 54 is of the second type of knit structure (e.g., pointelle stitch knit). Also, the holes 42*a*, 42*b* of the lateral and medial lines of broguing 40*a*, 40*b* are formed via the knitting step, as opposed to being formed via removal of material (e.g., punching, cutting, etc.) after the knitting step. As shown in FIG. 5, the knitted element 20 also includes lateral and medial heel areas 70*a*, 70*b* of the second type of knit structure (e.g., pointelle stitch knit), lateral and medial midfoot areas 72*a*, 72*b* of the second type of knit structure (e.g., pointelle stitch knit), and lateral and medial eyestay areas 74*a*, 74*b* of the second type of knit structure (e.g., pointelle stitch knit). Broguing holes forming lines of broguing (the same or similar in form and construction to the lateral and medial lines of broguing 40*a*, 40*b*) are between the lateral heel area 70*a* and the lateral midfoot area 72*a*, between the lateral midfoot area and the lateral eyestay area 74*a*, between the lateral midfoot region and the second area 52, between the lateral eyestay area and the second area, between the medial heel area 70*b* and the medial midfoot area 72*b*, between the medial midfoot area and the medial eyestay area 74*b*, between the medial midfoot region and the second area, and between the medial eyestay area and the second area.

After the knitted element 20 is knitted via the knitting step 100, the knitted element is pressed with a hot press during a pressing step, indicated at reference number 102 in FIG. 6.

During step 104, the upper 14 is formed by attaching a strobel board 80 (see FIG. 2)) to the knitted element 20, attaching the tongue 22 to the knitted element, and attaching the upper lateral heel region 24*a* to the upper medial heel region 24*b*. A heel counter 82 (see FIG. 1) may also be attached to the inner surface of the upper lateral and medial heel regions 24*a*, 24*b*. The upper 14 is then placed around a last at step 106. Adhesive is applied to the underside of the strobel board 80, and the upper 14 is passed via a conveyer through an oven (or heat tunnel). The oven heats the adhesive and also heats the hot melt yarn of the knitted element 20. The heating and subsequent cooling of the hot melt yarn causes the hot melt yarn to affix to the other yarns (e.g., to the polyester yarn or polyester covered spandex yarn) so that the upper 14 conforms to the shape of the last. The sole 12 and welt 16 are bonded via the adhesive to the strobel board 80 and bottom periphery of the knitted element at step 108.

An inner surface of the knitted element 20 (i.e., the surface facing the inside of the shoe 10) may be lined or unlined. In an unlined configuration, the inner surface of the knitted element 20 is devoid of a lining (other than the heel counter 82 or eyelet reinforcement adjacent the throat) and such inner surface of the knitted element defines at least a majority of a foot receiving cavity of the shoe. In a completely lined configuration, a lining is between the inner surface of the knitted element and the foot receiving cavity of the shoe such that the foot receiving cavity of the shoe is in part defined by the lining (instead of by the inner surface of the knitted element).

In view of the foregoing, it should be appreciated that the invention has several advantages over the prior art.

As various modifications could be made in the constructions and methods herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents It should also be understood that when introducing elements of the present invention in the claims or in the above description of exemplary embodiments of the invention, the terms "comprising," "including," and "having" are intended to be open-ended and mean that there may be additional elements other than the listed elements. Additionally, the term "portion" should be construed as meaning some or all of the item or element that it qualifies. Moreover, use of identifiers such as first, second, and third should not be construed in a manner imposing any relative position or time sequence between limitations.

What is claimed is:

1. A shoe comprising:

a knit upper;

a sole secured to the upper;

the knit upper having a knitted element, the knitted element being formed of a unitary one-piece construction during a knitting process on a knitting machine, the knitted element comprising a knitted upper heel region, a knitted upper lateral midfoot region, a knitted upper medial midfoot region, a knitted upper metatarsal region, a knitted upper lateral ball region, a knitted upper medial ball region, and a knitted upper toe region, the knitted upper metatarsal region including a knitted upper lateral metatarsal region and a knitted upper medial metatarsal region, the upper having a knitted upper lateral side region and a knitted upper medial side region, the upper lateral side region including the upper lateral midfoot region, the upper lateral metatarsal region and the upper lateral ball region, the upper medial side region including the upper medial midfoot region, the upper medial metatarsal region and the upper medial ball region, the upper toe region being seamlessly knitted with the upper medial and lateral ball regions during the knitting process, the upper medial and lateral ball regions being seamlessly knitted with the knitted upper metatarsal region during the knitting process, the knitted kupper metatarsal region being seamlessly knitted with the upper lateral and medial midfoot regions during the knitting process, the knitted element including a wingtip pattern, the wingtip pattern being portions of at least the upper toe region, the upper lateral and medial ball regions, and the upper lateral and medial metatarsal regions;

the knitted element comprising a first area of a first type of knit structure and a second area of a second type of knit structure, the second type of knit structure being different from the first type of knit structure, the first area having a rear boundary, the second area having a forward boundary, the rear boundary of the first area and the forward boundary of the second area being coincident and coextensive with each other and defining a boundary line between the first and second areas, the wingtip pattern comprising the boundary line, the boundary line having a medial boundary line and a lateral boundary line, the medial boundary line comprising a wing-shaped curved line having a medial side portion extending forward from at least the upper medial metatarsal region to the upper toe region and a central portion extending rearward from the upper toe region, the lateral boundary line comprising a wing-shaped curved line having a lateral side portion extending forward from at least the upper lateral metatarsal region to the upper toe region and a central portion extending rearward from the upper toe region, the rearwardly extending central portion of the medial boundary line converging toward the rearwardly extending central portion of the lateral boundary line.

2. A shoe as set forth in claim 1 wherein the upper further comprises a throat, and wherein the apex points toward the throat.

3. A shoe as set forth in claim 1 wherein the first type of knit structure is more tightly knit than the second type of knit structure.

4. A shoe as set forth in claim 1 wherein the first type of knit structure is a jersey stitch knit and the second type of knit structure is a pointelle stitch knit.

5. A shoe as set forth in claim 1 wherein the knitted element comprises covered spandex yarn and hot melt yarn, the hot melt yarn being knitted with the covered spandex yarn during the knitting process.

6. A shoe as set forth in claim 5 wherein the hot melt yarns constitute at least 15% by mass of the knitted element.

7. A shoe as set forth in claim 6 wherein the covered spandex yarn constitute at least 50% by mass of the knitted element.

8. A shoe as set forth in claim 7 wherein the covered spandex yarn comprises polyester covered spandex yarn.

9. A shoe as set forth in claim 8 wherein the knitted element further comprises stretch yarn, the stretch yarn constituting at least 5% by mass of the knitted element.

10. A shoe as set forth in claim 5 wherein the covered spandex yarn has a linear density of between about 120 denier and about 180 denier, and wherein the hot melt yarn has a linear density of between about 80 denier and about 120 denier.

11. A shoe as set forth in claim 1 wherein the knitted element comprises polyester yarn and hot melt yarn, the hot melt yarn being knitted with the polyester yarn during the knitting process.

12. A shoe as set forth in claim 1 wherein the knitted element comprises hot melt yarn, the hot melt yarn constituting at least 15% by mass of the knitted element.

13. A shoe comprising:

a knit upper;

a sole secured to the upper;

the knit upper having a knitted element, the knitted element being formed of a unitary one-piece construction during a knitting process on a knitting machine, the knitted element comprising a knitted upper metatarsal region, a knitted upper lateral ball region, a knitted upper medial ball region, and a knitted upper toe region, the knitted upper metatarsal region including a knitted upper lateral metatarsal region and a knitted upper medial metatarsal region, the upper having a knitted upper lateral side region and a knitted upper medial side region, the upper lateral side region including the upper lateral metatarsal region and the upper lateral ball region, the upper medial side region including the upper medial metatarsal region and the upper medial ball region, the upper toe region being seamlessly knitted with the upper medial and lateral ball regions during the knitting process, the upper medial and lateral ball regions being seamlessly knitted with the knitted upper metatarsal region during the knitting process, the knitted element including a wingtip pattern, the wingtip pattern being portions of at least the upper toe region, the upper lateral and medial ball regions, and the upper lateral and medial metatarsal regions;

the knitted element comprising a first area of a first type of knit structure and a second area of a second type of knit structure, the second type of knit structure being different from the first type of knit structure, the first area having a rear boundary, the second area having a forward boundary, the rear boundary of the first area and the forward boundary of the second area being coincident and coextensive with each other and defining a boundary line between the first and second areas, the wingtip pattern comprising the boundary line, the boundary line having a medial boundary line and a lateral boundary line, the medial boundary line comprising a wing-shaped curved line having a medial side portion extending forward from at least the upper medial metatarsal region to the upper toe region and a central portion extending rearward from the upper toe region, the lateral boundary line comprising a wing-shaped curved line having a lateral side portion extending forward from at least the upper lateral metatarsal region to the upper toe region and a central portion extending rearward from the upper toe region, the rearwardly extending central portion of the medial boundary line converging toward the rearwardly extending central portion of the lateral boundary line.

14. A shoe as set forth in claim 13 wherein the wingtip pattern comprises a medial line of broguing and a lateral line of broguing, the upper toe region, the upper lateral and medial ball regions, and the upper lateral and medial metatarsal regions collectively being knitted with the medial and lateral lines of broguing, the medial line of broguing comprising a wing-shaped curved line of holes having a medial side broguing portion extending forward from at least the upper medial metatarsal region to the upper toe region and a central broguing portion extending rearward from the upper toe region, the lateral line of broguing comprising a wing-shaped curved line of holes having a lateral side broguing portion extending forward from at least the upper lateral metatarsal region to the upper toe region and a central broguing portion extending rearward from the upper toe region, the rearwardly extending central broguing portion of the medial line of broguing converging toward the rearwardly extending central broguing portion of the lateral line of broguing.

15. A shoe as set forth in claim 14 wherein the central broguing portions of the medial and lateral lines of broguing meet at a rearwardly pointing apex.

16. A shoe as set forth in claim 13 wherein the first type of knit structure is a jersey stitch knit and the second type of knit structure is a pointelle stitch knit.

17. A shoe as set forth in claim 13 wherein the first type of knit structure is more tightly knit than the second type of knit structure.

18. A method of manufacturing an upper for an article of footwear, the method comprising:

knitting with a knitting machine to form a knitted element of the upper such that the knitted element is of a unitary one-piece construction comprising a knitted upper heel region, a knitted upper lateral midfoot region, a knitted upper medial midfoot region, a knitted upper metatarsal region, a knitted upper lateral ball region, a knitted upper medial ball region, and a knitted upper toe region, the knitted upper metatarsal region including a knitted upper lateral metatarsal region and a knitted upper medial metatarsal region, the upper having a knitted upper lateral side region and a knitted upper medial side region, the upper lateral side region including the upper lateral midfoot region, the upper lateral metatarsal region and the upper lateral ball region, the upper medial side region including the upper medial midfoot region, the upper medial metatarsal region and the upper medial ball region, the upper toe region being seamlessly knitted with the upper medial and lateral ball regions during the knitting process, the upper medial and lateral ball regions being seamlessly knitted with the knitted upper metatarsal region during the knitting process, the knitted upper metatarsal region being seamlessly knitted with the upper lateral and medial midfoot regions during the knitting process, the knitted element including a wingtip pattern, the wingtip pattern being portions of at least the upper toe region, the upper lateral and medial ball regions, and the upper lateral and medial metatarsal regions, the knitted element comprising a first area of a first type of knit structure and a second area of a second type of knit structure, the second type of knit structure being different from the first type of knit structure, the first area having a rear boundary, the second area having a forward boundary, the rear boundary of the first area and the forward boundary of the second area being coincident and coextensive with each other and defining a boundary line between the first and second areas, the wingtip pattern comprising the boundary line, the boundary line having a medial boundary line and a lateral boundary line, the medial boundary line comprising a wing-shaped curved line having a medial side portion extending forward from at least the upper medial metatarsal region to the upper toe region and a central portion extending rearward from the upper toe region, the lateral boundary line comprising a wing-shaped curved line having a lateral side portion extending forward from at least the upper lateral metatarsal region to the upper toe region and a central portion extending rearward from the upper toe region, the rearwardly extending central portion of the medial boundary line converging toward the rearwardly extending central portion of the lateral boundary line;

the upper toe region being seamlessly knitted with the upper medial and lateral ball regions during the knitting step;

the upper medial and lateral ball regions being seamlessly knitted with the knitted upper metatarsal region during the knitting step;

the knitted upper metatarsal region being seamlessly knitted with the upper lateral and medial midfoot regions during the knitting step;

the first and second areas and the wingtip pattern being seamlessly knitted during the knitting step.

19. A method as set forth in claim 18 wherein the knitted element includes a line of broguing adjacent the boundary line, the knitted element being knitted with the line of broguing during the knitting step.

20. A method as set forth in claim 18 wherein the knitted element includes a medial line of broguing and a lateral line of broguing, the medial line of broguing being adjacent the medial boundary line, the lateral line of broguing being adjacent the lateral boundary line, the medial line of broguing comprising a curved line of holes, the lateral line of broguing comprising a curved line of holes, the knitted element being knitted with the medial and lateral lines of broguing during the knitting step.

21. A method of manufacturing an article of footwear having a knitted upper and a sole, the method comprising:

knitting with a knitting machine to form a knitted element of the upper such that the knitted element is of a unitary one-piece construction comprising a knitted upper heel region, a knitted upper lateral midfoot region, a knitted upper medial midfoot region, a knitted upper metatarsal region, a knitted upper lateral ball region, a knitted upper medial ball region, and a knitted upper toe region, the knitted upper metatarsal region including an upper lateral metatarsal region and an upper medial metatarsal region, the knitted element having an upper lateral side region and an upper medial side region, the upper lateral side region including the upper lateral midfoot region, the upper lateral metatarsal region and the upper lateral ball region, the upper medial side region including the upper medial midfoot region, the upper medial metatarsal region and the upper medial ball region, the knitted element comprising a first area of a jersey stitch knit and a second area of a pointelle stitch knit, the first area being at least in the upper toe region, the second area being at least in the upper lateral and medial metatarsal regions, the first area having a rear boundary, the second area having a forward boundary, the rear boundary of the first area and the forward boundary of the second area being coincident and coextensive with each other and defining a boundary line between the first and second areas;

attaching the sole to the upper;

the upper toe region being seamlessly knitted with the upper medial and lateral ball regions during the knitting step;

the upper medial and lateral ball regions being seamlessly knitted with the knitted upper metatarsal region during the knitting step;

the knitted upper metatarsal region being seamlessly knitted with the upper lateral and medial midfoot regions during the knitting step;

the first and second areas being knitted during the knitting step.

22. A method as set forth in claim 21 wherein the knitted element includes a line of broguing adjacent the boundary line, the knitted element being knitted with the line of broguing during the knitting step.

23. A method as set forth in claim 21 wherein the boundary line comprises a medial boundary line and a lateral boundary line, and wherein the knitted element includes a medial line of broguing and a lateral line of broguing, the medial line of broguing being adjacent the medial boundary line, the lateral line of broguing being adjacent the lateral boundary line, the medial line of broguing comprising a curved line of holes, the lateral line of broguing comprising a curved line of holes.

24. A method as set forth in claim 23 wherein the knitted element is knitted with the medial and lateral lines of broguing during the knitting step.

25. A method as set forth in claim 24 wherein the upper is knitted during the knitting step with at least first and second yarns, the first yarn being of a hot melt yarn, the second yarn being of a yarn other than a hot melt yarn.

26. A method as set forth in claim 25 further comprising:

placing the upper around a last;

applying heat to the upper while the upper is around the last to cause the hot melt yarn to affix to the second yarn.

27. A method as set forth in claim 21 wherein the knitted element further includes a knitted lateral eyestay area and a knitted medial eyestay area, the knitted upper lateral midfoot region including a knitted lateral midfoot area, the knitted upper medial midfoot region including a knitted medial midfoot area, and wherein broguing holes forming lines of broguing are between the lateral midfoot area and the lateral eyestay area and between the medial midfoot area and the medial eyestay area, wherein the knitted element is knitted with the broguing holes during the knitting step.

28. A method as set forth in claim 21 wherein the knitted upper lateral midfoot region includes a knitted lateral midfoot area and the knitted upper medial midfoot region includes a knitted medial midfoot area, and wherein broguing holes forming lines of broguing are between the lateral midfoot area and the second area and between the medial midfoot area and the second area, wherein the knitted element is knitted with the broguing holes during the knitting step.

* * * * *